US007077600B1

(12) United States Patent
Whinery

(10) Patent No.: US 7,077,600 B1
(45) Date of Patent: Jul. 18, 2006

(54) MULTIPLE SENSORY ROAD MARKING TAPE

(76) Inventor: Christopher S. Whinery, 18690 U.S. Hwy. 64, Haskell, OK (US) 74436

( * ) Notice: Subject to any disclaimer, the term of this patent is extended or adjusted under 35 U.S.C. 154(b) by 0 days.

(21) Appl. No.: 11/226,973

(22) Filed: Sep. 15, 2005

(51) Int. Cl.
*E01F 9/08* (2006.01)

(52) U.S. Cl. ..... 404/14; 404/12

(58) Field of Classification Search ..... 404/9, 404/12, 13, 14, 15, 16; 359/531; 116/63 R
See application file for complete search history.

(56) References Cited

U.S. PATENT DOCUMENTS

| | | | | |
|---|---|---|---|---|
| 1,661,242 | A | 3/1928 | Truxal | |
| 1,736,830 | A * | 11/1929 | McKee et al. | 404/15 |
| 1,928,447 | A * | 9/1933 | Cornell, Jr. | 404/12 |
| 2,127,233 | A * | 8/1938 | Older | 404/12 |
| 2,268,538 | A | 12/1941 | Redli | |
| 2,875,675 | A | 3/1959 | Searight | |
| 3,086,431 | A | 4/1963 | Perry | |
| 3,179,009 | A * | 4/1965 | Sheffield et al. | 404/16 |
| 3,334,554 | A * | 8/1967 | Adams | 116/63 P |
| 3,399,607 | A | 9/1968 | Elgenmann | |
| 3,427,933 | A | 2/1969 | Taylor-Myers | |
| 3,516,337 | A * | 6/1970 | Gunther | 404/9 |
| 3,879,148 | A * | 4/1975 | Eigenmann | 404/10 |
| 4,040,760 | A * | 8/1977 | Wyckoff | 404/14 |
| RE31,291 | E | 6/1983 | Eigenmann | |
| 4,648,689 | A | 3/1987 | May | |
| 4,687,369 | A * | 8/1987 | McDonald | 404/12 |
| 4,792,259 | A | 12/1988 | Eigenmann | |
| 4,993,868 | A * | 2/1991 | Eigenmann | 404/12 |
| 5,006,010 | A * | 4/1991 | Duckett | 404/12 |
| 5,242,242 | A * | 9/1993 | Young | 404/12 |
| 5,437,907 | A | 8/1995 | Peil | |
| 5,865,943 | A | 2/1999 | Marty | |
| D470,787 | S | 2/2003 | Kim | |
| 6,752,568 | B1 | 6/2004 | Stone | |
| 6,758,567 | B1 * | 7/2004 | Attar | 359/531 |
| 6,776,555 | B1 | 8/2004 | Kuo | |

FOREIGN PATENT DOCUMENTS

| | | | |
|---|---|---|---|
| EP | 0 299 386 | * | 1/1989 |
| GB | 2 048 508 | * | 12/1980 |

OTHER PUBLICATIONS

3M 'Application of Stamark™ Pre-Cut Symbols and Legends' May, 2002 10 pages.*
3M 'Guidelines for Pavement Marking Applications in Grooved Pavement Surfaces' Apr., 2002 8 pages.*

* cited by examiner

*Primary Examiner*—Gary S. Hartmann
(74) *Attorney, Agent, or Firm*—Randal D. Homburg

(57) ABSTRACT

A roadway marking system, comprising a roadway marking tape and a plurality of spaced reflective roadway markers having a white reflective front surface, a red reflective rear surface and a elevated crest, is applied to an upper surface of a roadway. The roadway marking tape has a lower surface with an expandable adhesive material and a plurality of contoured roadway spikes, projecting from the reflective roadway markers which are exposed from the lower surface through the adhesive material. When downward pressure is applied to the upper surface of the roadway marking tape and the elevated crest of the reflective roadway markers, the roadway marking system becomes permanently attached to the upper surface of the roadway with the adhesive material providing a permanent adhesive seal between the marking tape and the roadway surface. Once attached to the roadway, the roadway marking system provides an audible, tactile and visual warning to a driver traveling on the roadway over the roadway marking system.

4 Claims, 2 Drawing Sheets

MULTIPLE SENSORY ROAD MARKING TAPE

CROSS REFERENCE TO RELATED APPLICATIONS

None

I. BACKGROUND OF THE INVENTION

1. Field of Invention

A roadway marking tape applied to an upper surface of a roadway combines a continual upper reflective surface applied to the upper surface of the marking tape, incorporating a plurality of spaced elevated pavement markers having a white reflective front surface and a red reflective rear surface, the marking tape having an expandable adhesive material applied to a lower surface of the marking tape within which are embedded a plurality of contoured roadway spikes which are exposed from the lower surface through the adhesive material when pressure is applied to the upper surface when applying the roadway marking tape, the spikes permanently attaching the marking tape to the upper surface of the roadway with the adhesive material providing a permanent adhesive seal between the marking tape and the roadway surface.

2. Description of Prior Art

The following United States patents were discovered and are disclosed within this application for utility patent. All relate to either roadway markers or roadway tape.

The first category of prior art patents deal with reflective roadway marking tape. These type patents generally disclose an upper reflective surface and a lower adhesive. These patent include U.S. Pat. No. 3,399,607 to Eigenmann, U.S. Pat. No. 4,648,689 to May and U.S. Pat. No. 5,437,907 to Peil. U.S. patent to Rodli discloses a painting material that places a reflective material at certain predetermined location during application. In U.S. Pat. No. 1,661,242 to Truxal, flat material is to be attached to a roadway surface using what appears to be a bolt.

A second set of patent is disclosed that deal with reflective markers which are fastened to a roadway surface and are elevated above the roadway surface. Some of these have reflective and retro-reflective components which appear visible from a vertical perspective seen in a horizontal perspective. These patent include U.S. Pat. No. 3,427,933 to Taylor-Myers, RE 31,291 to Eigenmann, D470,787 to Kim and U.S. Pat. No. 6,776,555 to Kuo.

The last set of patents dealt with machines to apply roadway markers and material. These patents included U.S. Pat. No. 2,875,675 to Searight, U.S. Pat. No. 3,086,431 to Perry, U.S. Pat. No. 4,792,259 to Eigenmann, and U.S. Pat. No. 6,752,568 to Stone. A device similar to Stone would be suggested for application of the roadway tape which is the subject of the present invention, dispensing a reel of marking tape similar to the manner that is disclosed in the Eigenmann patent. An apparatus for applying an adhesive marking material, but to a vertical surface, is also disclosed in U.S. Pat. No. 5,865,943 to Marty.

While disclosing similar individual elements as the present invention, none of the disclosed patents contain the combined elements of the present invention, especially in the presentation of the roadway spikes to the lower surface of the marking tape embedded within the expanded adhesive layer and the disclosed pavement markers attached within the upper surface of the tape.

II. SUMMARY OF THE INVENTION

As noted in the above section, roadway marking materials have been known in the art of roadway construction for several years. Most of these markers are intended to visibly indicate the boundaries of a lane, or to convey information to drivers as to roadway conditions during daylight hours with a pigment different from the roadway surface of a reflective component to be seen in one's headlights during hours of darkness. Some devices have included warning features that are audibly conveyed when a driver drives over them, either producing a noise when the tire drives over them periodically or in the manner of a washboard. This also conveys a tactile alert by either a bump when driving over the elevated device or a vibration felt as in warning devices on a roadway shoulder.

The problems addressed in the prior art patents and the industry deal with application of the roadway marking material, the durability of the markers or material used in the markers, and the ability to communicate multiple warning indicators within the marking material, especially to combine a visual, audible and tactile warning in the same device.

The present marking tape presents a continuous length of marking tape having a reflective upper surface to which is attached a plurality of spaced reflective roadway markers. Each roadway marker has a low angle inclined front section within which is placed a white reflective lens, an upper crest and an abrupt angle inclined rear section within which is placed a red reflective lens. A lower portion of the reflective roadway marker extends onto a lower surface of the marking tape. An anchored base portion of the contoured roadway spike attaches to the lower portion of the roadway marker, the roadway spike further defining a pointed tip and expanded portion, the pointed tip directed towards the roadway surface. An expandable adhesive material is provided along the lower surface of the marking tape. The roadway spike extending from the lower portion is presented embedded within the adhesive material prior to application.

When applied to a roadway surface, the marking tape is extended along the roadway surface where application is contemplated and pressure is applied to the upper surface of the marking tape and the upper crest of the roadway marker, driving the roadway spike through the adhesive material into the roadway surface to attach the roadway marker to the roadway surface, with a constant pressure along the upper surface of the marking tape forcing the adhesive material outward and providing a permanent seal of the marking tape to the roadway surface.

The marking tape may be provided in a rolled length or may be provided in a prefabricated pattern to indicate roadway warning signs or in letters to convey information, including turn arrows, school zones, safety zones, merge indicators, meridians, lane markers, no passing zones, or any other formed roadway sign or marking media.

III. DESCRIPTION OF THE DRAWINGS

The following drawings are submitted with this utility patent application.

IV. DESCRIPTION OF THE PREFERRED EMBODIMENT

Figure 1:
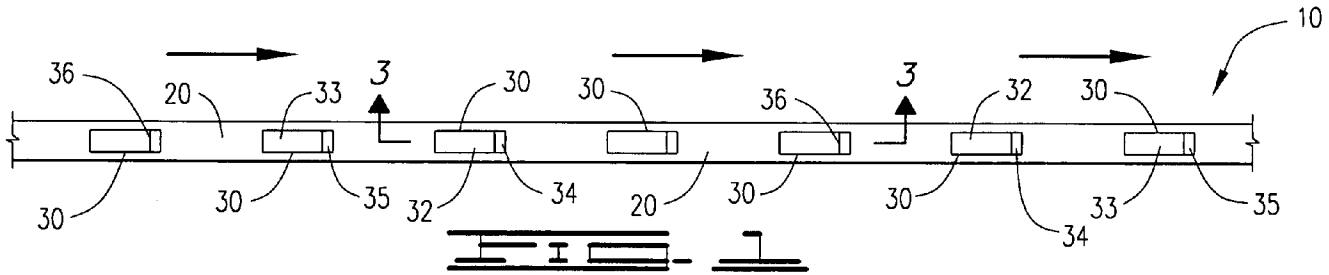
FIG. 1 is a top view of a first embodiment of the marking tape.

A road surface marking tape 10 providing a multiple sensory means of delineating roadway margins and traffic information on a roadway surface 100, shown in FIGS. 1–7 of the drawings, the marking tape 10 comprising a reflective upper surface 20 to which is attached a plurality of spaced reflective roadway markers 30, each roadway marker 30 having an inclined front section 32 having a white reflective lens 33, an inclined rear section 34 having a red reflective lens 35, an upper crest 36 and a base portion 38 from which extends a contoured roadway spike 40, the roadway spike 40 further defining a pointed tip 42 and an expanded portion 44, and a lower surface 50 to which is applied an expandable adhesive material 60, the pointed tip 42 of the roadway spike 40 directed from the base portion 38 and through the expandable adhesive material 60 towards the roadway surface 100. The roadway spike 40 is partially embedded within the adhesive material 60 prior to application of the marking tape 10 to the roadway surface 100, FIG. 2, the roadway spike 40 forced into the roadway surface 100 expanding the adhesive material 60 when applied to the roadway surface 100 by a pressure or impact force, the adhesive material 60 compressing and permanently adhering the lower surface 38 of the marking tape 10 to the roadway surface 100, FIG. 3.

Application of the marking tape 10 would involve cleaning a roadway surface 100 from dirt, debris and roadway surface materials, placing the marking tape 10 upon the cleaned roadway surface 100, applying a downward force onto the upper crest 36 of the roadway marker 30 and the upper surface 20 of the marking tape 10, driving the pointed tip 42 of the roadway spike 40 into the roadway surface 100 and compressing the adhesive material 60 on the lower surface 38 of the marking tape 10 resulting in permanent adhesion of the adhesive material 60 and the lower surface 38 of the marking tape 10 to the roadway surface 100.

A soft surfaced weighted roller device, disclosed in prior art referenced previously in the specification, would be preferred for application of the marking tape 10. A hard surfaced weighted roller device would not be suitable, as the hard surface may cause damage to or crush the roadway marker 30 or the white or red reflective lenses 33, 35.

Figure 2:
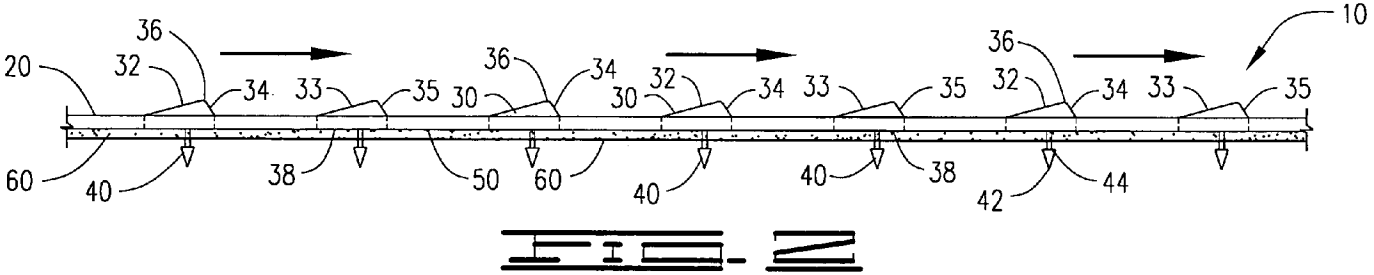
FIG. 2 is a side cross-section of the marking tape.
Figure 3:
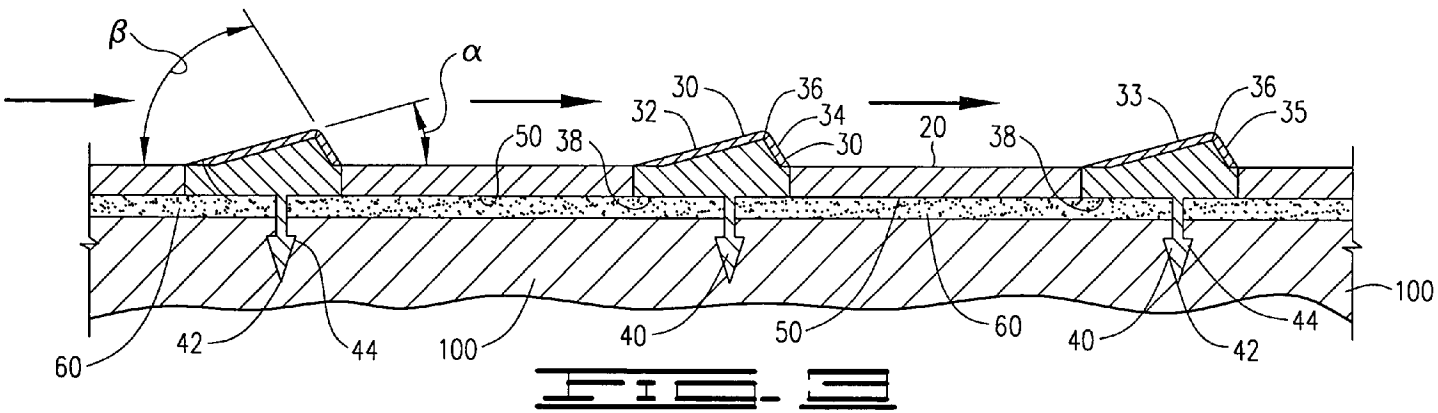
FIG. 3 is a cross section of the marking tape upon attachment to a roadway surface along section lines 3/3 of FIG. 1.
Figure 4:
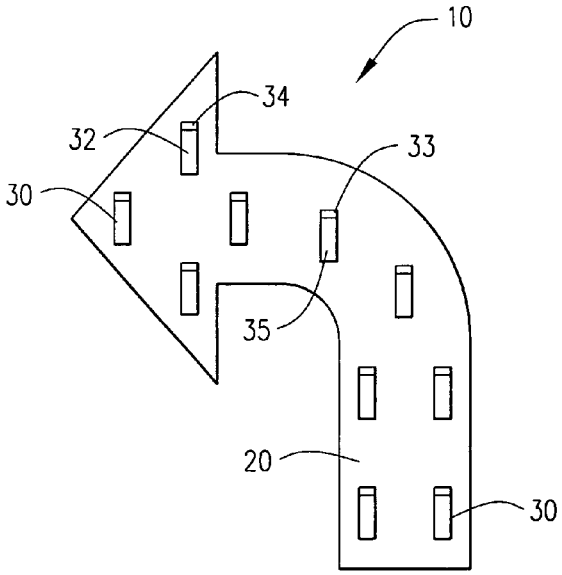
FIG. 4 is a top view of a second embodiment of the marking tape in a roadway indicator.
Figure 5:
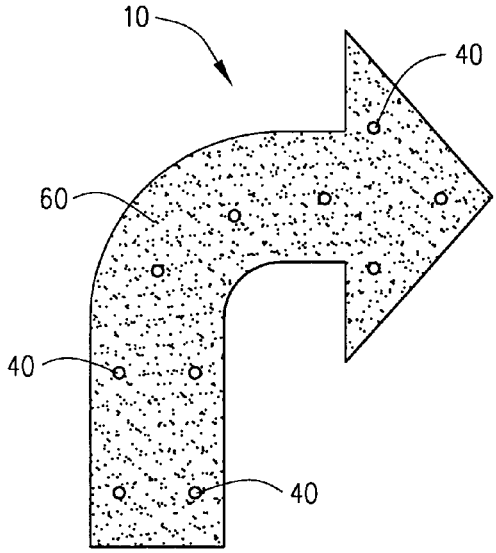
FIG. 5 is a lower view of the second embodiment of the marking tape in a roadway indicator.
Figure 6:
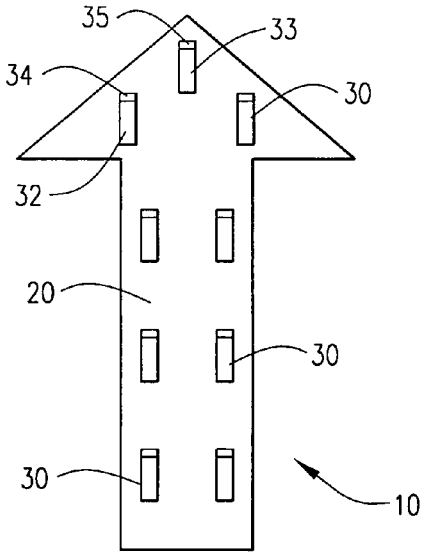
FIG. 6 is a top view of a third embodiment of the marking tape in a roadway indicator.
Figure 7:
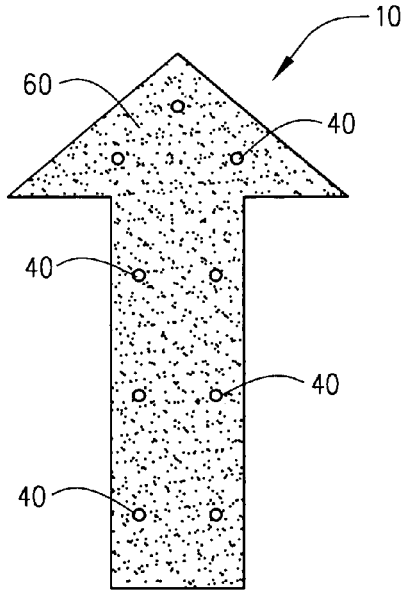
FIG. 7 is a lower view of the third embodiment of the marking tape in a roadway indicator.

In a first embodiment, FIGS. 1–3, the marking tape 10 is a linear strip preferably presented wound upon a reel, similar to that found on a roll of tape, with the lower surface 38 directed to the outside of the reel. In this embodiment, the marking tape 10 is supplied for use as a linear marking material, as would be used to mark a roadway margin, a roadway divider or to compose a roadway marking, roadway traffic information or lettering for words applied to a roadway surface. A segment of the marking tape 10 would be unrolled and pressure applied to the upper surface 20 of the marking tape 10 and to the upper crest 36 of the roadway marker 30 forcing the roadway spike 40 into the roadway surface 100 once the marking tape 10 is located where permanent application is desired.

In a second and third embodiment, FIGS. 2–7, the marking tape 10 is presented in prefabricated sheets with roadway marking patterns already formed, as indicated in FIGS. 4–7 of the drawings. These second and third embodiments may be presented as a traffic lane directional indicator, FIGS. 6–7, as a turn indicator, FIGS. 4–5, or letters indicating common traffic information including "pedestrian crossing", "school zone", "stop ahead" and "reduced speed ahead", not shown.

It is preferred that the white reflective lenses 33 would be facing the proper direction of travel, indicated by the arrows of FIGS. 1–3, and the red reflective lenses 35 would be facing the direction against the flow of traffic, thus promoting a white reflection to indicate proper direction to a driver at night with the red reflective lenses against the flow of traffic to convey to a driver at night that they are driving in an improper direction over that segment of the roadway. It is also preferred that the inclined front section 32 of the roadway marker 30 would be provided at a first angle $\alpha$ of less than 20 degrees to the roadway surface, causing a slight impact to a tire to riding over the first angle $\alpha$ producing a slight audible noise, while the inclined rear section 34 of the roadway marker would be provided at a second angle $\beta$ of greater than 50 degrees, causing a greater impact to a tire riding over the second angle $\beta$ producing a greater audible noise.

By combining the reflective upper surface 20, the white reflective lens 33 and the red reflective lens 35 on the roadway marker 30, and the first angle $\alpha$ and second angle $\beta$ on the roadway markers 30, three human senses are stimulated as a vehicle drives along the roadway with this roadway marking tape 10. First, the marking tape 10 provides a dual visual stimulus to a driver at night by means of the reflective upper surface 20 and the reflective lenses 33, 35 in the roadway markers 30. The marking tape 10 would also provide a daytime visual stimulus if the upper surface 20 of the marking tape 10 were provided in a color which would be a stark contract color to the roadway surface 100, as is now seen on roadways as bright white or yellow. Second, the marking tape 10 and the reflective markers 30 provide an audible stimulus to a driver, by the tires of a vehicle making noise when they travel over the upper crest 36 of the roadway marker 30. When traveling over a repeating line of roadway markers 30, a hum or rapid bumping noise is produced. This is already presented in the art where multiple elevated roadway marking devices are applied in a line in a roadway. Third, a tactile vibration is produced when the vehicle tires travel over the roadway markers 30, felt by not only the driver, but by all those in the vehicle. Thus, if a driver is having a hard time staying awake at night and the marking tape 10 is applied to the lane margins in a roadway, the vibration felt would at least alert an occupant of the vehicle to the fact that the vehicle has crosses a lane boundary and that the driver may or may not be paying attention to the vehicle operation during travel in a safe manner.

While the invention has been particularly shown and described with reference to a preferred embodiment thereof, it will be understood by those skilled in the art that changes in form and detail may be made therein without departing from the spirit and scope of the invention.

What is claimed is:

1. A roadway marking system attaching to a roadway surface, providing a multiple sensory means of delineating roadway margins and traffic information, said marking tape comprising:

a roadway marking tape having a reflective upper surface to which is attached a plurality of spaced reflective roadway markers, each roadway marker having an inclined front section having a white reflective lens, an angle inclined rear section having a red reflective lens, an upper crest and a base portion from which extends a contoured roadway spike, said roadway spike further defining a pointed tip and an expanded portion; and said roadway marking tape having a lower surface to which is applied an expandable adhesive material, said pointed tip of said roadway spike directed through said lower surface and said expandable adhesive material towards said roadway surface, wherein said roadway spike is partially embedded within said adhesive material prior to application of said marking tape to said roadway surface and is forced by a pressure or impact force into said roadway surface, said adhesive material compressing and permanently adhering to said roadway surface.

2. The roadway marking system, as disclosed in claim 1, further comprising:

said white reflective lenses facing oncoming traffic along a proper direction of travel and said red reflective lenses facing away from oncoming traffic along said proper direction of travel, thus promoting a white reflection to indicate proper direction to a driver at night with said red reflective lenses against said proper direction of travel to convey to said driver at night that said driver is driving in an improper direction over said roadway surface, and said inclined front section of said roadway marker provided at a first angle of less than 20 degrees to said roadway surface, causing a slight impact to a tire to riding over said first angle producing a slight audible noise, while said inclined rear section of said roadway marker would be provided at a second angle of greater than 50 degrees, causing a greater impact to a tire riding over said second angle and producing a greater audible noise.

3. The roadway marking system, as disclosed in claim 1, further comprising:

said marking tape is presented in prefabricated sheets with roadway marking patterns formed, presented as traffic lane directional indicators, turn indicators, letters, numbers or shapes.

4. A method of applying said roadway marking system disclosed in claim 1, said method comprising the steps of:

cleaning a roadway surface from dirt, debris and roadway surface materials;

placing said roadway marking system with said lower surface of said roadway marking tape placed upon a clean roadway surface;

applying a downward force onto said upper crest of said roadway marker and said upper surface of said roadway marking tape;

driving said pointed tip of said roadway spike into said roadway surface; and compressing said adhesive material on said lower surface of said marking tape resulting in permanent adhesion of said adhesive material and said lower surface of said marking tape to said roadway surface.

* * * * *